US011660514B1

(12) United States Patent
Black et al.

(10) Patent No.: US 11,660,514 B1
(45) Date of Patent: May 30, 2023

(54) INTERACTIVE PROJECTILE GAME

(71) Applicant: 5th Down LLC, Tampa, FL (US)

(72) Inventors: Christian Black, Tampa, FL (US); Tim Black, Houston, TX (US)

(73) Assignee: 5th Down LLC, Tampa, FL (US)

( * ) Notice: Subject to any disclaimer, the term of this patent is extended or adjusted under 35 U.S.C. 154(b) by 0 days.

(21) Appl. No.: 18/066,343

(22) Filed: Dec. 15, 2022

Related U.S. Application Data

(60) Provisional application No. 63/290,401, filed on Dec. 16, 2021.

(51) Int. Cl.

| | |
|---|---|
| ***A63B 67/00*** | (2006.01) |
| ***A63B 63/00*** | (2006.01) |
| ***A63B 71/06*** | (2006.01) |
| ***A63B 69/40*** | (2006.01) |

(52) U.S. Cl.
CPC ..... *A63B 67/002* (2013.01); *A63B 63/00* (2013.01); *A63B 69/406* (2013.01); *A63B 71/0605* (2013.01); *A63B 71/0669* (2013.01); *A63B 2063/001* (2013.01); *A63B 2220/805* (2013.01)

(58) Field of Classification Search
CPC ..... A63B 67/002; A63B 63/00; A63B 69/406; A63B 71/0605; A63B 71/0669; A63B 2063/001; A63B 2220/805
See application file for complete search history.

(56) References Cited

U.S. PATENT DOCUMENTS

| | | | | |
|---|---|---|---|---|
| 2,059,365 | A * | 11/1936 | King | A63B 63/00 273/395 |
| 4,275,883 | A * | 6/1981 | Grimaldi | A63B 47/025 473/432 |
| 6,641,139 | B2 * | 11/2003 | Lamberti | F41J 5/14 273/378 |
| 2017/0348582 | A1 * | 12/2017 | Cho | A63B 69/40 |
| 2022/0233942 | A1 * | 7/2022 | Ferrabee | G06T 7/75 |

* cited by examiner

*Primary Examiner* — Jeffrey S Vanderveen
(74) *Attorney, Agent, or Firm* — Shumaker, Loop & Kendrick, LLP; Jeffry B. Fabian

(57) ABSTRACT

Disclosed is an interactive projectile game system that collects projectiles launched by a user toward a target and that returns the launched projectiles to the user. The system includes an actuator, a launcher assembly, a projectile, one or more targets, and a projectile collection system proximal to the targets. A user selects the actuator to activate the launcher assembly to propel the projectile to the user. The user receives or retrieves the projectile and propels the projectile toward the targets in an effort to score points by striking a target. The projectile collection system receives the projectile after being launched by the user, and the projectile collection system transfers the projectile back to the launcher assembly.

15 Claims, 9 Drawing Sheets

INTERACTIVE PROJECTILE GAME

TECHNICAL FIELD AND BACKGROUND

The present invention relates generally to an interactive game, and more particularly, an interactive projectile game where users launch projectiles toward one or more targets.

Conventional games that involve propelling projectiles, such as balls or pucks, toward targets require users to draw from a limited source container of projectiles. When there are no more projectiles left in the source container, the game stops. Users are then required to gather the previously launched projectiles before resuming the game. This can be a time consuming process particularly when the game includes numerous projectiles or targets that are located a significant distance from where a user propels or launches the projectile.

Alternatively, a separate person is tasked with the onerous responsibility of continuously gathering the previously launched projectiles for return to the player. In that case, the game necessarily requires two people one of which might be paid to gather projectiles.

To overcome the drawbacks of conventional games, the present system automatically retrieves the projectiles and feeds the projectiles to a launcher assembly. Upon selection of an actuator by the user, the launcher assembly returns the projectiles to the user. In this manner, the system permits automated, continuous operation by a single person that conventional game systems do not provide. The interactive game system can include stationary or mobile targets and other features that provide an immersive, realistic experience for users as though users were participating in a live sporting event.

SUMMARY

One embodiment of the interactive projectile game system includes an actuator, a launcher assembly, a projectile, one or more targets, and a projectile collection system proximal to the targets. A user selects the actuator to activate the launcher assembly to propel the projectile to a user position. The user receives or retrieves the projectile and propels the projectile toward the targets in an effort to score points by striking a target. The projectile collection system receives the launched projectile and transfers the projectile back to the launcher assembly.

The targets can be made from openings in a front screen where the front screen is spaced a distance from the user position. Alternatively, the targets can be an image projected on the front screen. The system can also include a back scoring panel adjacent to a rear side of the front screen that is opposite the user position where the user propels projectiles toward the targets. Target sensors can be secured to various locations on the back scoring panel. The target sensors can be, for example, infrared or other optical detection sensors. The target sensors are optionally secured to the back scoring panel in a position aligned with the target openings when the targets are formed as openings in the front screen.

The system can also include a system controller and a scoreboard display device. When a projectile passes through the target opening or strikes a target projected on the front screen, the target sensor generates a scoring signal that is transmitted to the system controller. The system controller converts the scoring signal into a point value that is displayed on the scoreboard display device. The system can include a plurality of targets that each correspond to a predetermined point value.

The projectile collection system can be implemented with a series of connected conveyor belt assemblies, including a front conveyor assembly that runs at least partially along a length of a foot of the front screen (i.e., the bottom of the front screen as shown in FIG. 1). The front conveyor belt assembly is installed on a side of the front screen opposite the user position (i.e., the rear side of the front screen). The front conveyor belt assembly can be installed in a position that is at a lower height than the top surface of a platform where the user position is located. The lower height facilitates collection of projectiles striking the front side of the front screen where the projectiles can fall underneath the front screen onto the front conveyor belt assembly. To that end, the interactive projectile game system can also include a lower energy damper that is installed proximal to the foot of the front screen on a side of the front screen facing the user position. The lower energy damper can have an accurate, L-shaped, or other shape that slopes downward underneath the front screen toward the front conveyor assembly to direct projectiles to the front conveyer assembly.

The launcher assembly can be formed with an object feeder, a first wheel and a second wheel, and a space between the first wheel and the second wheel where the space is sized to accommodate the projectile. The object feeder can include a tray, bucket, or other surface to hold a projectile in place. The object feeder translates linearly to place the projectile between the two wheels. The wheels are coupled to one or more motors that rotate the wheels. The rotation of the wheels causes the wheels to frictionally engage the projectile and propel the projectile toward a user position. More specifically, selecting the actuator activates the object feeder to place the projectile in the space between the first wheel and the second wheel, and when the projectile is placed in the space between the first wheel and the second wheel, the first wheel and the second wheel frictionally engage the projectile and propel the projectile toward the user.

The interactive projectile game system can include a projectile collection system having (i) a front conveyor belt assembly coupled to a shuffler conveyor belt assembly, and (ii) an elevation conveyor belt assembly coupled to the shuffler conveyor belt assembly. The front conveyor belt assembly receives the projectile launched toward the target and transfers the projectile to the shuffler conveyor belt assembly. The shuffler conveyor belt assembly transfers the projectile to the elevation conveyor belt assembly, and the elevation conveyor belt assembly transfers the projectile to the launcher assembly.

The system includes a conveyor actuation sensor coupled to the elevation conveyor belt assembly. The conveyor actuation sensor is configured to detect the projectile while the elevation conveyor belt assembly is in motion. When the conveyor actuation sensor detects the projectile, the conveyor actuation sensor transmits a projection detection signal to the controller. When the controller receives the projection detection signal, the controller transmits a conveyor stop signal to the projection collection system. Finally, when the projection collection system receives the conveyor stop signal, the projection collection system stops the elevation conveyor belt assembly motion.

In one embodiment, the interactive projectile game system includes an (i) actuator, (ii) a launcher assembly that includes an object feeder, (iii) a projectile loaded within the object feeder, (iv) at least one target, (v) a projectile collection system proximal to the at least one target, and (vi) a controller in signal communication with each of the actuator, the launcher, and the projectile collection system. When a user selects the actuator, the actuator transmits a projectile return signal to the controller. The controller receives the projectile return signal and transmits a launch activation signal to the launcher assembly. The launcher assembly receives the launch activation signal, and the launcher assembly propels the projectile to a user position. The user accepts the projectile and propels the projectile toward the target. The projectile collection system receives the projectile, and the projectile collection system transfers the projectile to the object feeder.

In another embodiment, the system includes (i) an actuator, (ii) a launcher assembly, (iii) a projectile, (iv) a tracking system, (v) a screen, (vi) an image projector that projects one or more target images onto the screen, and (vii) a projectile collection system. Selecting the actuator activates the launcher assembly to propel the projectile toward a user position. The user then propels the projectile toward one of the target images projected onto the screen. The tracking system detects and records the projectile flight path and a strike position where the projectile impinges upon the screen. Next, the projectile collection system receives the projectile, and the projectile collection system transfers the projectile to the launcher assembly. The tracking system can be configured to detect the projectile flight path utilizing a light detection and ranging sensor. And the screen can be formed as a wrap-around screen extending at least partially around the user position.

BRIEF DESCRIPTION OF THE DRAWINGS

Features, aspects, and advantages of the present invention are better understood when the following detailed description of the invention is read with reference to the accompanying drawings, in which.

DETAILED DESCRIPTION

Figure 1:
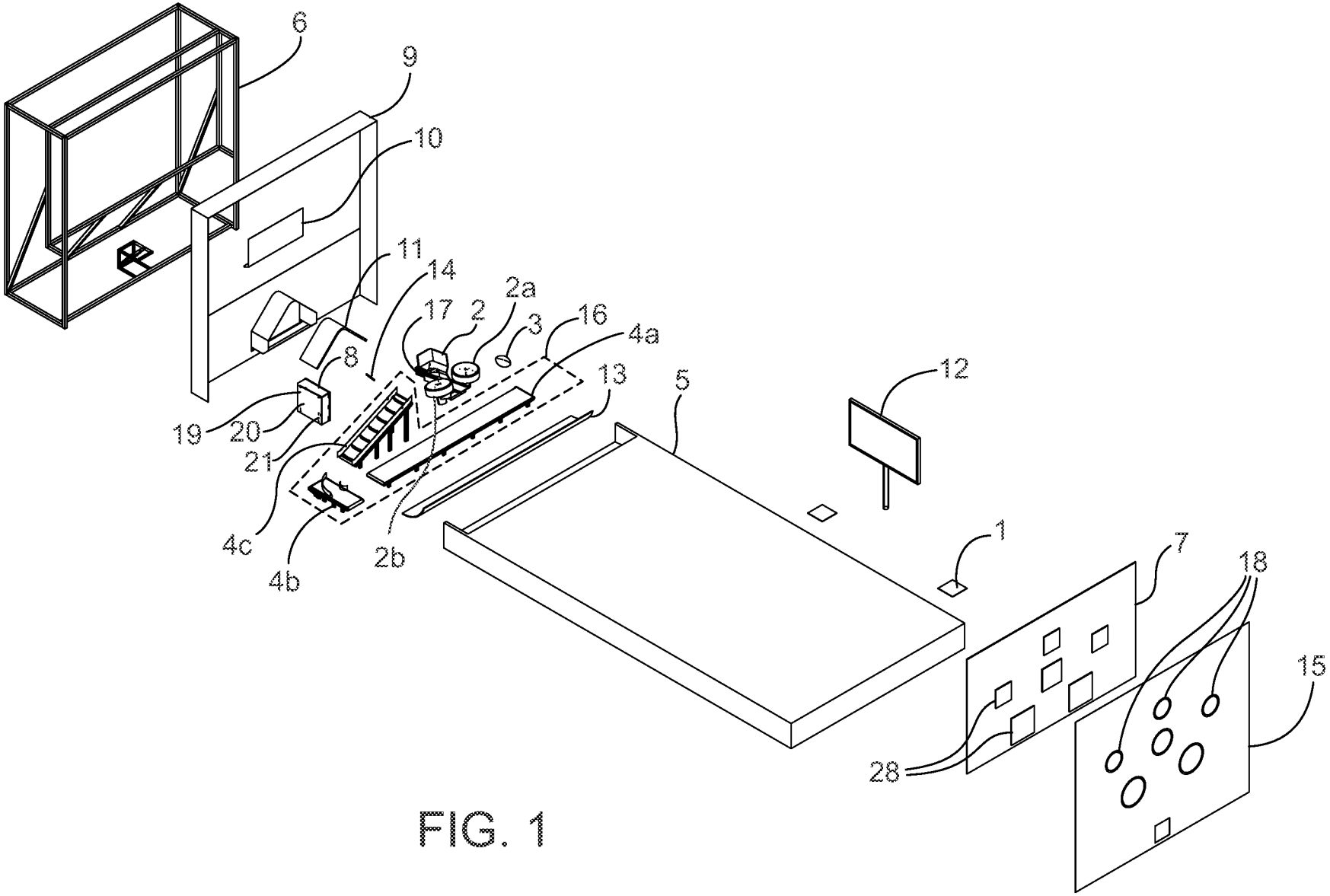
FIG. 1 is an exploded view of an interactive projectile game system according to one embodiment.
Figure 2:
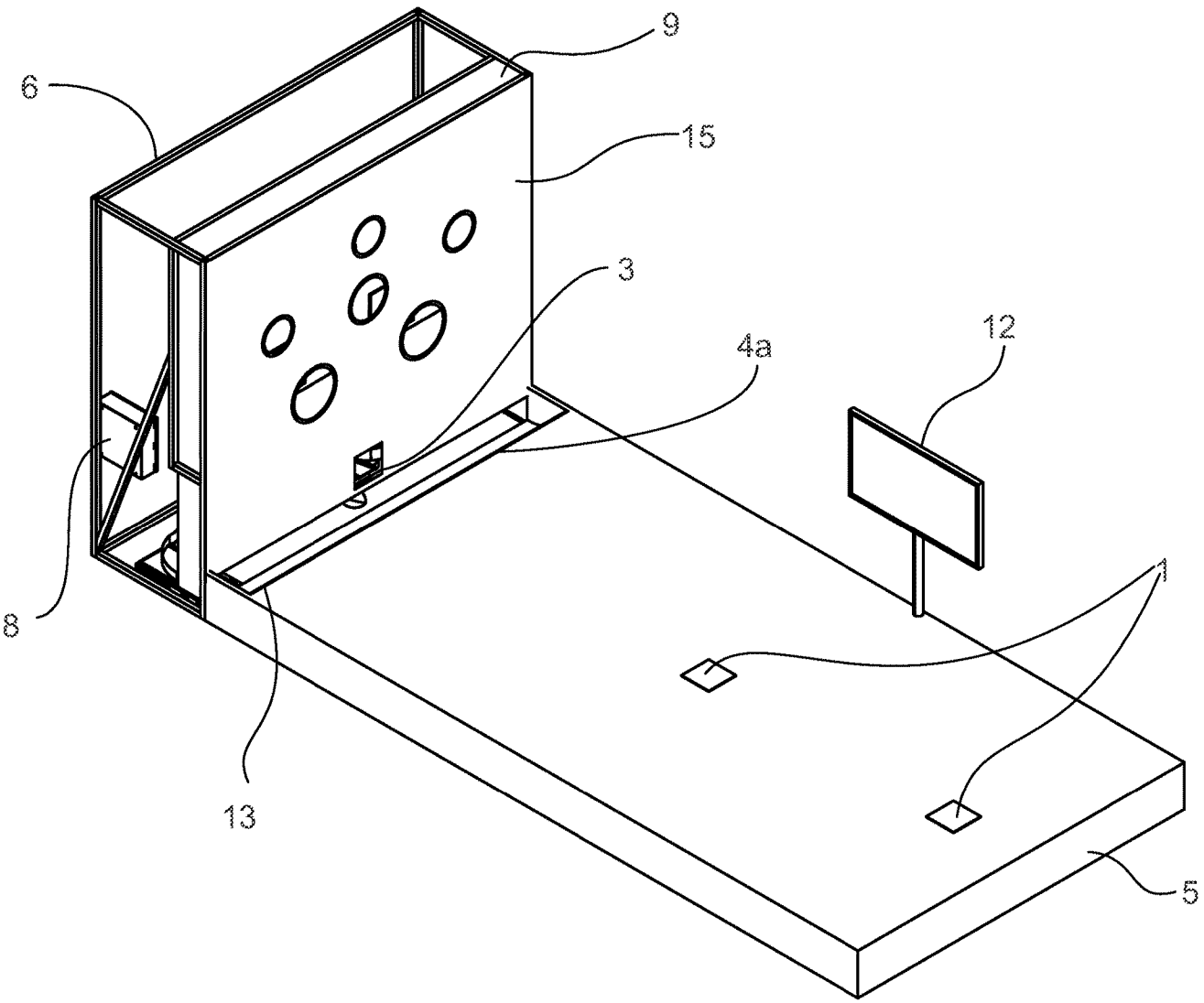
FIG. 2 is an assembled perspective view of an interactive projectile game system according to one embodiment.
Figure 3:
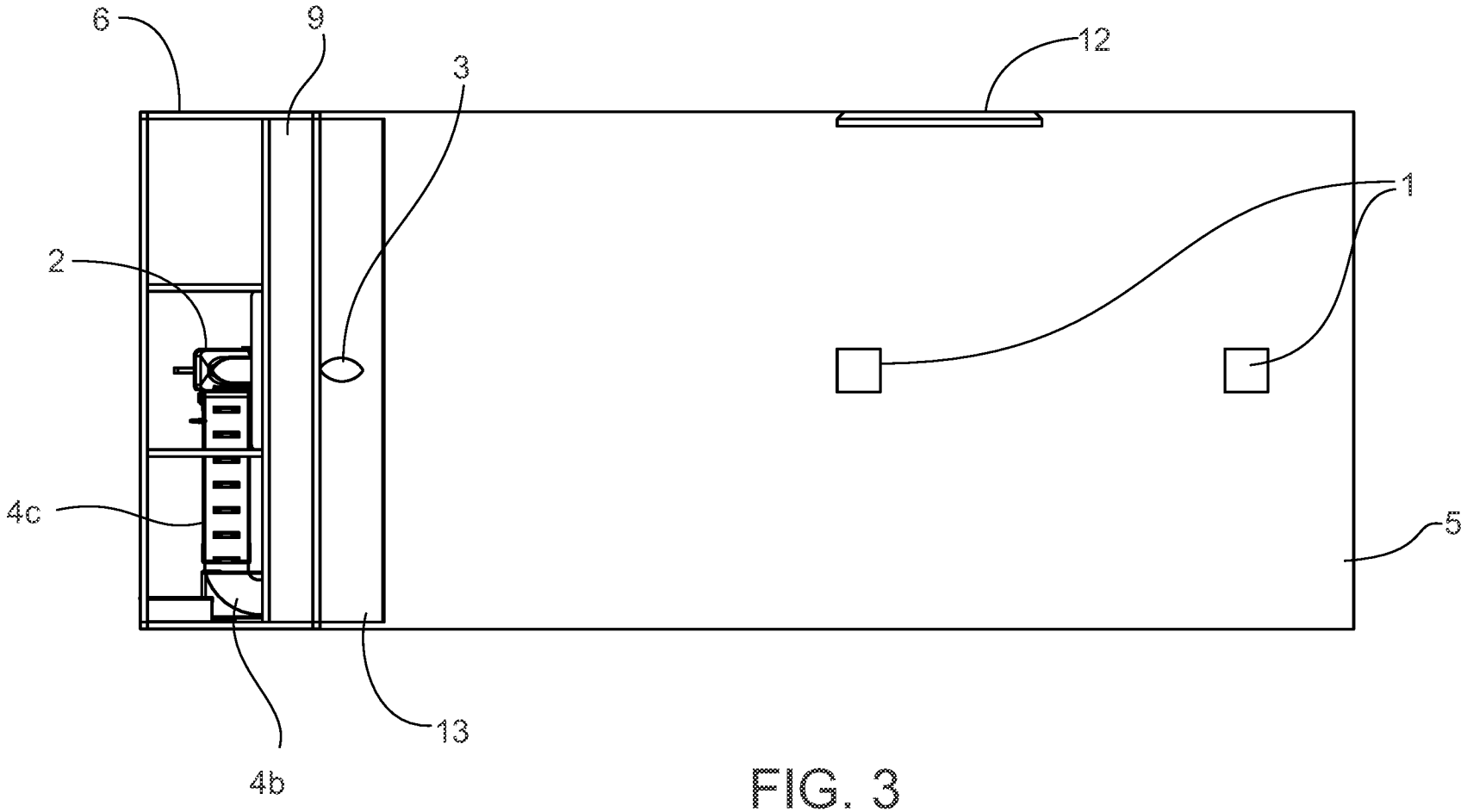
FIG. 3 is a top view of an interactive projectile game system according to one embodiment.
Figure 4:
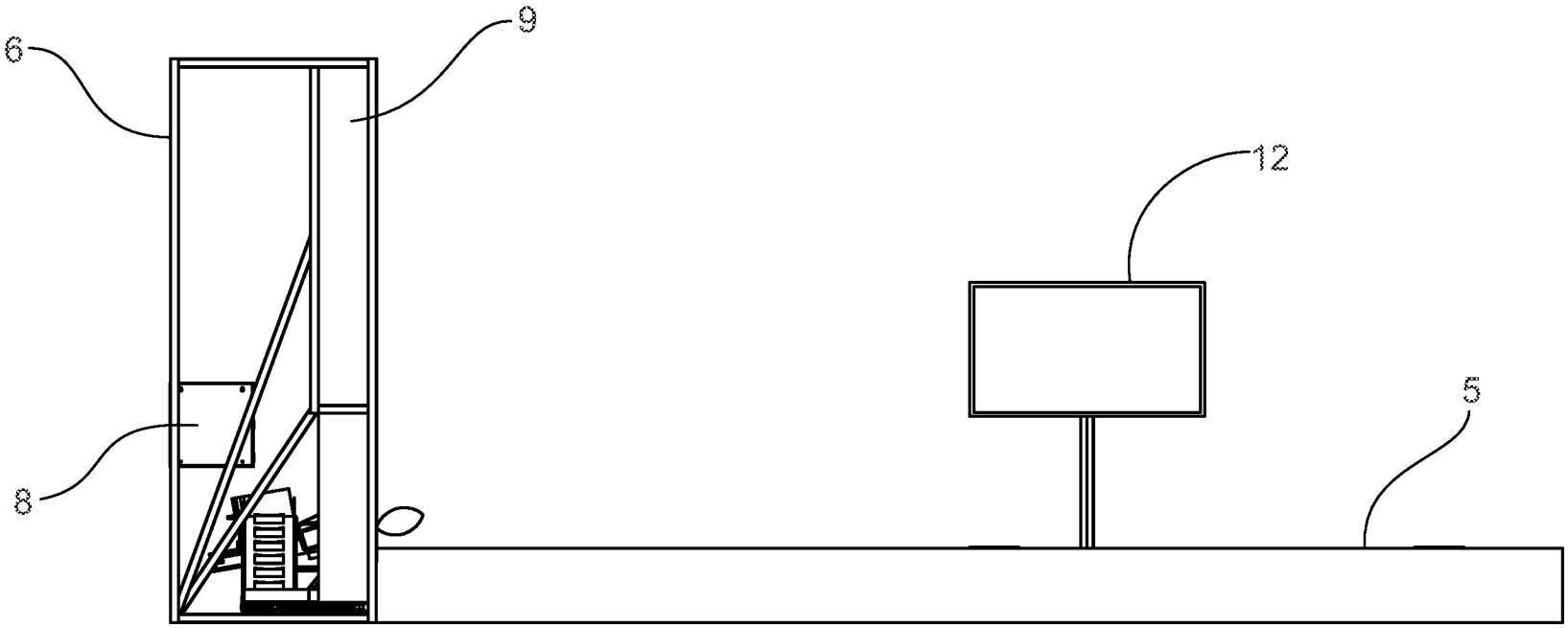
FIG. 4 is a side view of an interactive projectile game system according to one embodiment.
Figure 5:
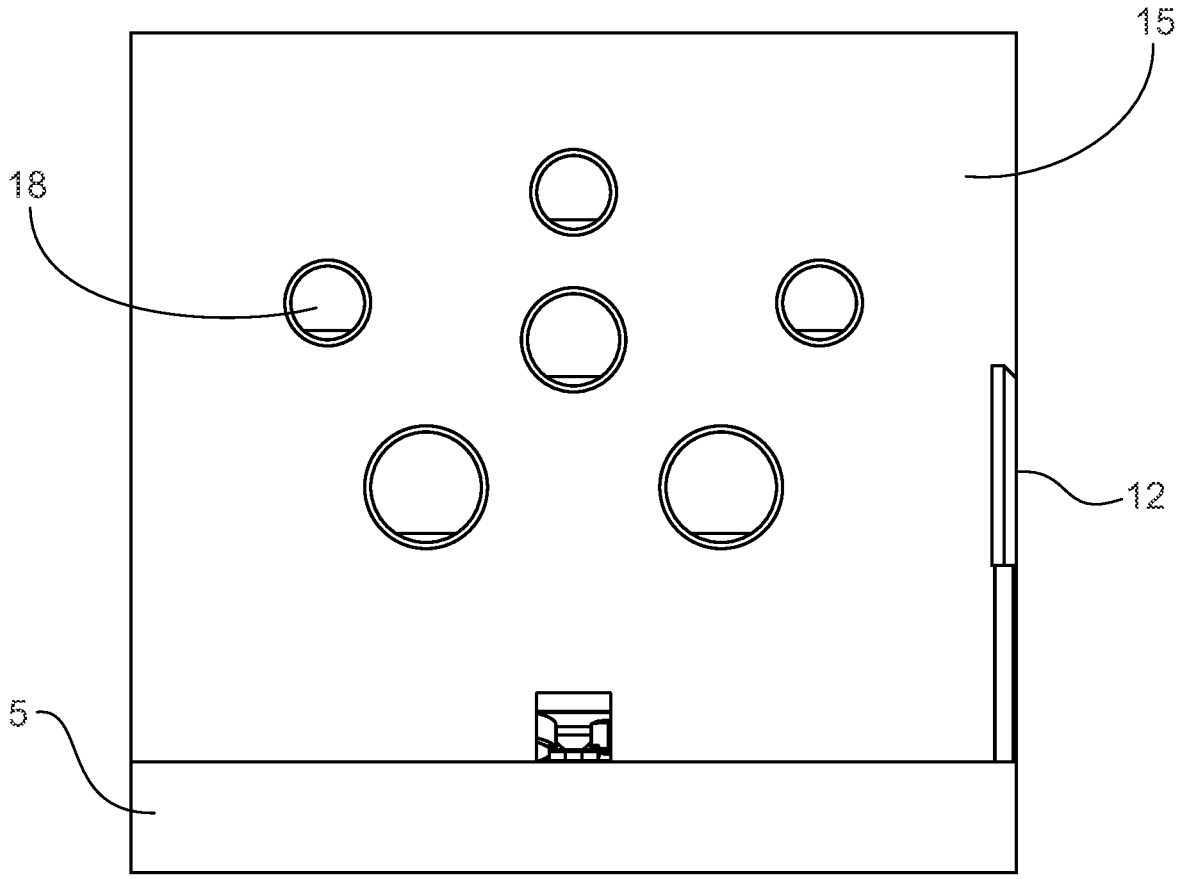
FIG. 5 is a front view of an interactive projectile game system according to one embodiment.

The present invention will now be described more fully hereinafter with reference to the accompanying figures in which exemplary embodiments of the invention are shown. However, the invention may be embodied in many different forms and should not be construed as limited to the representative embodiments set forth herein. The exemplary embodiments are provided so that this disclosure will be both thorough and complete and will fully convey the scope of the invention and enable one of ordinary skill in the art to make, use, and practice the invention.

Relative terms such as lower or bottom; upper or top; upward, outward, or downward; forward or backward; and vertical or horizontal may be used herein to describe one element's relationship to another element illustrated in the figures. It will be understood that relative terms are intended to encompass different orientations in addition to the orientation depicted in the drawings. By way of example, if a component in the drawings is turned over, elements described as being on the "bottom" of the other elements would then be oriented on "top" of the other elements. Relative terminology, such as "substantially" or "about," describe the specified materials, steps, parameters, or ranges as well as those that do not materially affect the basic and novel characteristics of the claimed inventions as whole, as would be appreciated by one of ordinary skill in the art.

As defined herein, the term "user" refers to a person that utilizes the disclosed systems and methods to play an interactive game, and the term is used interchangeably with "person" or "player." The term "projectile" refers to an object directed toward a target by a user as part of the interactive game and includes, without limitation, various types of balls (e.g., football, baseball, tennis ball) or other objects that can be launched aerially toward a target (e.g., hockey puck, birdie, Frisbee®, etc.).

Disclosed herein is an interactive game system where users receive a projectile 3 from a launcher assembly 2 that is actuated remotely by the user. Users attempt to score points by directing the projectile 3 towards a target 18 by throwing or kicking the projectile 3 or hitting the projectile 3 with a bat, hockey stick, tennis racket, or other instrument suitable for placing a projectile 3 in motion. The projectile 3 strikes a front screen 15 or other surface that absorbs momentum from the projectile 3 such that the projectile 3 falls and is collected by the front conveyor belt assembly 4*a* of a projectile collection system 16. The projectile collection system 16 transfers the projectile 3 from the front conveyor belt assembly 4*a* to the shuffler conveyor belt assembly 4*b*. The shuffler conveyor belt assembly 4*b* transfers the projectile 3 to the elevation conveyor belt assembly 4*c* for return to the user by the launcher assembly 2.

Unlike conventional systems that require a person to collect projectiles 3 for return to a user, the present system enables automated retrieval of projectiles 3 using a projectile collection system 16 for one-person launching operation. The system places the user in control by providing an actuator 1 that causes a launcher assembly 2 to propel the projectile 3 to the player on demand.

Conventional systems rely on projectiles to be either manually loaded into a launching device, or manually loaded into a source container (e.g., a bucket) that feeds an automatic launching device. Manually loaded launcher assemblies require a second person to launch each projectile to the player. Automatic, continuous launcher assemblies with manually loaded source containers require a second person to retrieve the projectiles and to keep the projectile source container filled for uninterrupted training or game play, or alternatively, the user gathers the projectiles and refills the source container for another series of launches.

The present systems and methods automate the projectile collection system 16 for continuous one-person operation. Additionally, the system places the player in control by providing an actuator 1 to initiate the launch and the process for retrieving the projectile 3. Conventional systems have not achieved a user-controlled actuator 1 or a multi-projectile 3 retrieval and launch system. The present system allows a user to more accurately mimic real-life sporting scenarios, such as the actions of a quarterback in shotgun formation during a football game.

Turning to the attached figures, the system includes an area called a platform 5 that accommodates one or more players. The player taps an actuator 1 with the player's foot or taps an actuator 1 on the player's wrist to activate a projectile 3 launcher assembly 2. The launcher assembly 2 sends the projectile 3 through the air to a user position. The user position can be located on the platform 5 and corresponds to a starting position where the user is located before propelling the projectile 3 toward the targets 18 in an attempt to score points. The user receives the projectile 3 (or retrieves the projectile 3) and throws or hits the projectile 3 toward a target 18 that is created or displayed on the front screen 15.

The front screen 15 can be made from a shock absorption material that provides an energy dampening function to absorb impact force from projectiles 3 that strike the front screen 15 without passing through one of the targets 18. Projectiles 3 that pass through a target 18 strike the back scoring panel 7 before falling and being collected by the projectile collection system 16. A plurality of target sensors 28 can be disposed on the back scoring panel 7 and aligned with the target 18 openings. The target sensors 28 detect projectile 3 strikes for projectiles 3 that pass through the target 18 opening.

A projectile 3 strike causes a target sensor 28 to generate a scoring signal that is transmitted to a computing device such as a system controller 21. The scoring signal can include a target sensor 28 identification that identifies the specific target sensor 28 that originated the scoring signal. The scoring signal can identify a particular target sensor 28 through variations in voltage level, amperage, resistance, capacitance, or through digital data such as a sensor identification number that is mapped to target sensor position data (e.g., a grid number location or coordinates). In some embodiments, each target sensor 28 can be formed as an array of smaller sensors that generate a single scoring signal transmitted to the system controller 21 or other computing device. In this manner, the system can determine a position on the sensor array where a projectile 3 strike occurred that can be used to determine a point value awarded.

The computing device registers the scoring signal as a successful scoring of points. The point value is stored to a relational scoring database along with other data that includes, without limitation: (i) a user identification for the user that propelled the projectile 3; (ii) a target sensor 28 identification that can be used to determine which target sensor 28 was impacted; (iii) a target sensor 28 position or location that can be used to determine the corresponding point value awarded; (iv) a time stamp for when the projectile strike occurred; (v) a launch series number that corresponds to the number of projectiles 3 launched in a given turn; (vi) an impact force measurement quantifying the force generated by a projectile 3 impact; or (vii) other data useful for tracking game play or training performance.

The value of points scored can vary according to factors that include the particular target 18 through which the projectile 3 passed. In some embodiments, the target sensor 28 can register additional data, such as the amount of force exerted by the projectile 3 on the target sensor 28 or the location on the target sensor 28 where a projectile 3 made contact. The amount of force detected or the location of a projectile 3 strike can in turn change the scoring signal and the value of points awarded. For example, a higher force projectile 3 strike can result in a higher point value award than a less forceful strike, and a projectile 3 strike closer to the center of a target sensor 28 can likewise result in a higher point value award than a strike closer to the edges of a target sensor 28.

In yet other embodiments, the individual target sensors 28 can be omitted, and the back scoring panel 7 can register projectile 3 strikes that pass through target 18 openings. As an example, the back scoring panel 7 can utilize technology similar to touch screen devices where the back scoring panel 7 registers changes in resistance, voltage, current, or capacitance caused by projectile 3 strikes. Projectile 3 strikes cause the back scoring panel 7 to generate a scoring signal that is registered as a score. The location and amplitude of such changes can also be detected and translated to a force or position measurement that is included in the scoring signal and used in determining the value of points awarded for a projectile 3 strike.

In yet other embodiments, target sensors 28 are disposed proximal to the edges of the back scoring panel 7 or in a matrix-like pattern where the target sensor 28 locations do not correspond to the target 18 openings. In that case, the target sensors 28 can be optical or photoelectric sensors that do not require direct contact with the sensor to register a projectile 3 strike on the back scoring panel 7.

The actuator 1 can be an electrical switch, a touchscreen display device (e.g., a device that senses changes in capacitance or resistance resulting from touch), a pressure sensor, or a tactile sensor. The actuator 1 can be integrated or in signal communication with a computing device that includes one or more integrated software applications that implement functions and commands that operate the system, including activating the launcher assembly 2. The actuator 1 can be connected to a computing device through a universal serial bus ("USB") or other suitable cable or placed in wireless communication with a computing device through a wireless communication protocol, such as Bluetooth®, Wi-Fi®, or near field communication.

The system components include a projectile launcher assembly 2 and projectile collection system 16. The launcher assembly 2 includes two rotating wheels **2*a* that can be made of a hard rubber or another material that is sufficiently rigid to accommodate a projectile placed between the wheels 2*a* and that has a sufficient coefficient of friction to grip the projectile 3 and generate force for a launch operation. The two wheels 2*a* are attached to two motors 2*b*** mounted to a frame made of tube steel or similar framing material.

Attached to the frame that supports the motors **2*b* and wheels 2*a* is a linear actuating object feeder 17. The object feeder 17 retains the projectile 3 in a tray or bucket and thrusts the projectile 3 into the rotating wheels 2*a*. In one embodiment, the object feeder 17 is connected to, and controlled by, the actuator 1 approximately twelve to twenty feet in front of the front screen 15. The system can be configured with varying distances between the actuator 1 and the front screen 15 to modify the skill level and challenge required to successfully hit or pass projectiles 3 through the targets 18** where larger distances require higher skill levels.

The object feeder 17 can include a linear actuating motor or other mechanism to implement linear motion, such as an electromechanical motor, a solenoid and magnetic plunger, a hydraulic drive, or pneumatic drive, among other mechanisms. The object feeder 17 can include a controller, switch, position sensor, or other electrical device capable of sending a signal to a system controller 21. The system controller 21 can be implemented as a programmable computing device that accepts signal inputs from electronic components of the system (e.g., sensors, computing devices, peripheral hardware, etc.) and that generates control signal outputs in response to the inputs.

The actuator 1 can be mounted flush with the top of the platform 5 on which the player is standing to permit foot actuation. Behind the front screen 15 is the front conveyor 4*a*. On one side of the launcher assembly 2, at the end of front conveyor 4*a*, is a shuffler conveyor belt assembly 4*b*. The projectile collection system 16 returns the projectile 3 to the launching position behind the front screen 15 in the center of the platform 5. Electrical power to the equipment is fed through a power supply 19 that is equipped with an emergency stop button 20.

The system can be operated by one or more computing devices in signal communication with one another, such as through a local area network. In one non-limiting example embodiment, the system includes one or more centralized network computing devices (e.g., servers) connected to the system controller 21, a platform computing device coupled to the scoreboard 12 and the actuator 1, and a target computing device coupled to the back scoring panel 7 and/or the target sensors 28.

As an example of system operation, the target computing device registers projectile 3 strikes on the back scoring panel 7 and target sensors 28 and translates the strikes into points, or scoring data, that can vary depending according to which target sensor 28 was hit, the force of the strike, or according to pre-programmed game rules (e.g., double points awarded for three consecutive target sensor 28 strikes, etc.). The target computing device transmits the scoring data to a network computing device and/or the system controller 21. The network computing device transmits the scoring and other data to the platform computing device for display on the scoreboard 12. The platform computing device can generate one or more graphical user interfaces displayed on the scoreboard 12 that further allows users to modify game rules and scoring, to add or remove players, among other functions.

The computing devices can include components such as: (i) a central processor unit; (ii) one or more memory devices coupled to the processor, such as random access memory or read-only memory; and (iii) a data storage device operatively coupled to the processor, including at least one of a non-transitory storage medium that stores computer-readable instructions for execution by the processor. The computer-readable instructions can include instructions for implementing an operating system and various software applications or programs. The storage device can store various data items, which can include, as non-limiting examples, cached data, user files, such as those for pictures, audio and/or video recordings, files downloaded or received from other devices, and other data items preferred by the user or required or related to any or all of the applications or programs.

By processing instructions stored on one or more storage devices, the processors may perform operations that implement the present systems. The user computing devices include one or more integrated software applications that provide graphical user interfaces ("GUI"), permit communication with other electronic devices, and generally carry out operations of the present systems. The computing devices may also utilize software applications that function using resource available through a third-party provider, such as a Software as a Service ("SasS"), Platform as a Service ("PaaS"), or Infrastructure as a Service ("IaaS") provider running on a third-party cloud service computing device. For instance, a cloud computing device may function as a resource provider by providing remote data storage capabilities or running software applications utilized by remote devices.

The projectile 3 launch and retrieval process can be better understood with the following example description of the process steps for system operation:

Step 1: With the projectile 3 in the ready position 25 on the object feeder 17, the player taps the actuator 1 with the player's foot or touches the actuator 1 on the player's arm or wrist. Selecting the first actuator 1 causes a linear actuator coupled to the object feeder 17 to move forward, which in turn pushes the object feeder 17 forward. The forward moving object feeder 17 pushes the projectile 3 between the rotating wheels 2*a* to launch the projectile 3. The object feeder 17 sends the projectile 3 to the player by thrusting the projectile 3 into a gap between the spinning wheels 2*a* before immediately retracting rearward to return to the ready position to receive another projectile 3. When the object feeder 17 thrusts the projectile 3 between the spinning wheels 2*a*, the wheels 2*a* grip and compress the projectile 3 with a pre-set tension that causes the projectile 3 to be propelled to the player.

Figure 7:
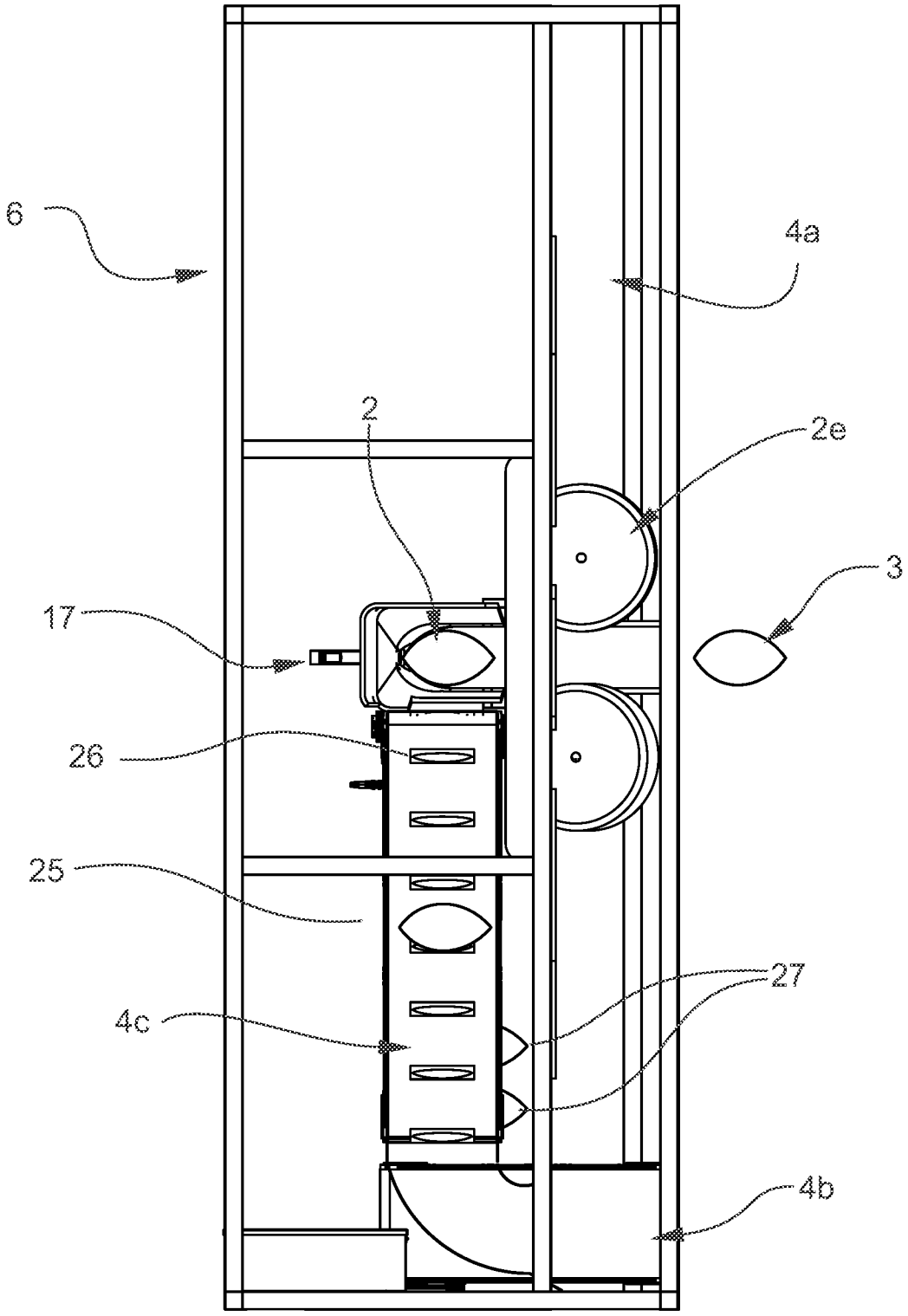
FIG. 7 is a top view of a launcher for an interactive projectile game system according to one embodiment.
Figure 8:
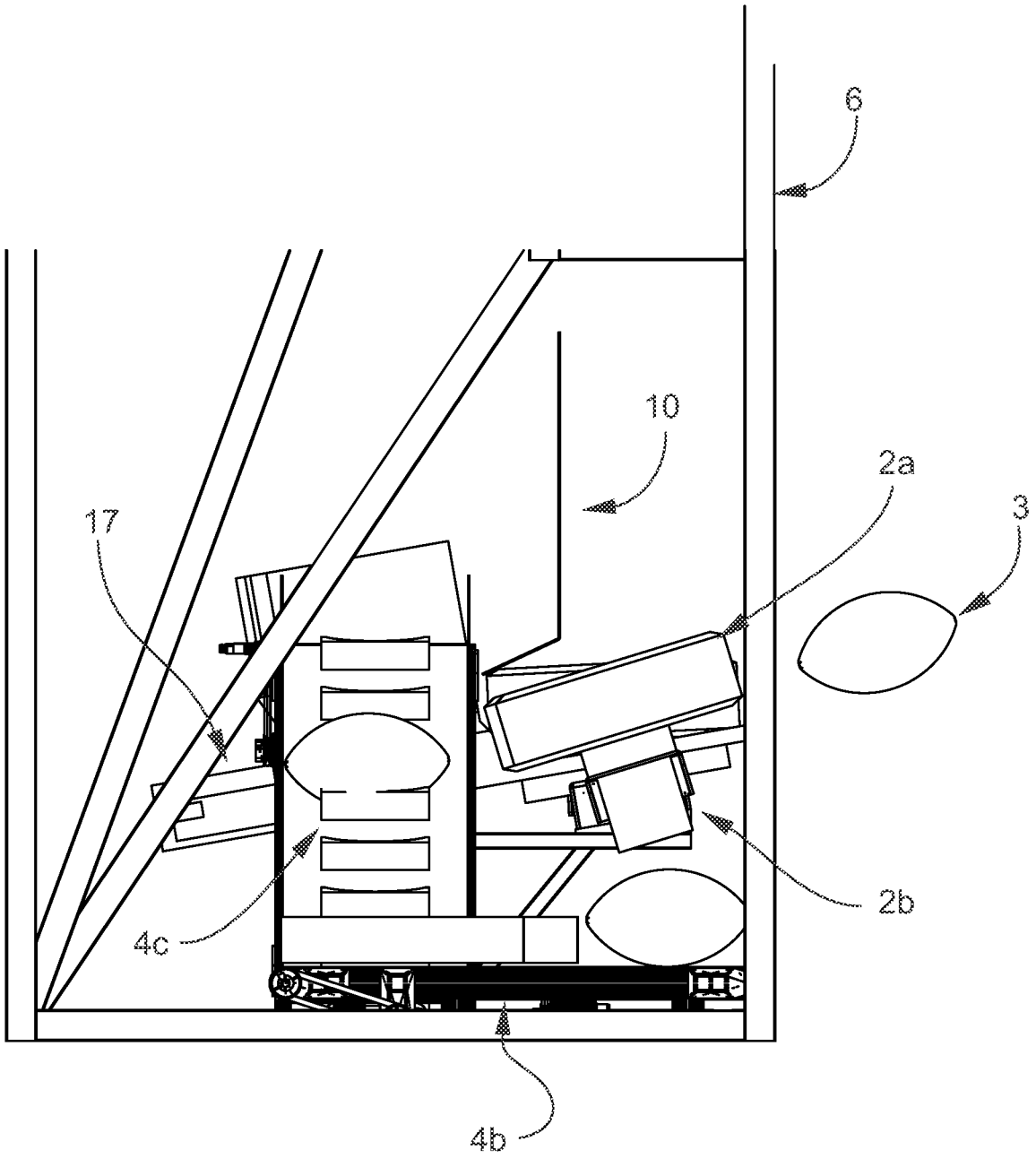
FIG. 8 is a side view of a launcher for an interactive projectile game system according to one embodiment.
Figure 9B:
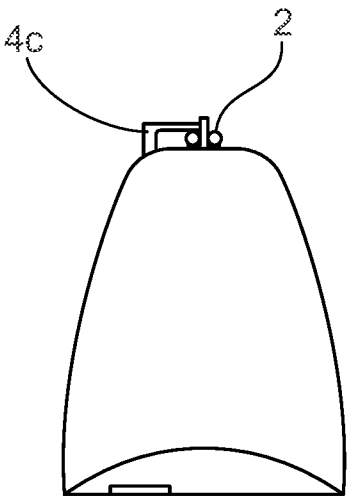
FIG. 9B is a top view of a wraparound screen used for an embodiment of an interactive projectile game system according to one embodiment.
Figure 9D:
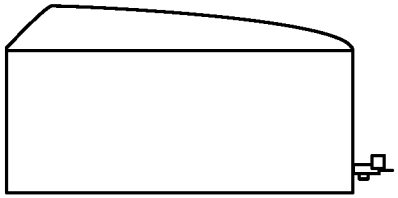
FIG. 9D is a cutaway, side view of a wraparound screen used for an embodiment of an interactive projectile game system according to one embodiment.
Figure 9A:
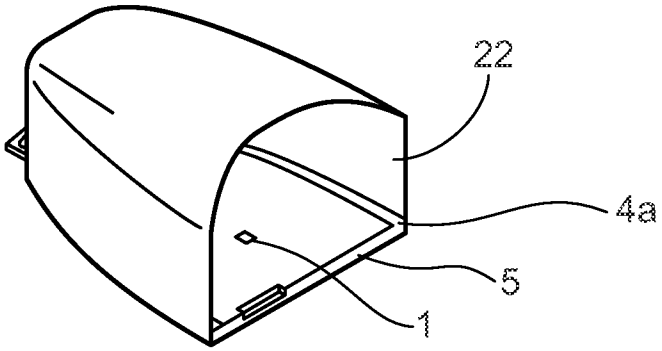
FIG. 9A is a perspective view of a wraparound screen used for an embodiment of an interactive projectile game system according to one embodiment.
Figure 9C:
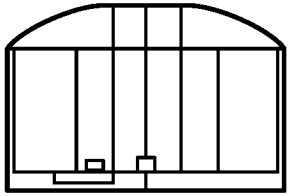
FIG. 9C is a front view of a wraparound screen used for an embodiment of an interactive projectile game system according to one embodiment.

To facilitate continuous, uninterrupted operation, the system can maintain one projectile 3 loaded in the object feeder 17 and a second projectile 3 located in the ready position 25 shown in FIG. 7. The ready position 25 is proximal to the end of the elevation conveyor belt assembly 4*c* that is closest to the object feeder 17.

Once a projectile 3 has been launched, object feeder 17 sends a projectile feed signal to the system controller 21 indicating that the object feeder 17 has returned to its retracted position. This in turn causes the system controller 21 to activate the shuffler conveyor belt assembly 4*b* and the elevation conveyor belt assembly 4*c*, which loads the projectile 3 currently in the ready position 25 into the object feeder 17. The projectile collection system 16 will then continue to run until the next projectile 3 is detected by the conveyor actuation sensor 14 located proximal to the ready position 25. The conveyor actuation sensor 14 sends a projectile detection signal to the system controller 21 indicating that the next projectile 3 is in the ready position 25 on the elevation conveyor belt assembly 4*c*. The projectile collection system 16 and the launcher assembly 2 will then remain at rest until the actuator 1 is activated again.

Step 2: The player receives the projectile 3 launched during step one and throws or hits the projectile 3 toward a target 18 on the front screen 15.

Step 3: If the projectile 3 misses the target 18, the projectile 3 strikes the front screen 15 and falls to the lower energy damper 13, which directs the projectile 3 to the front conveyor belt assembly 4*a*. The projectile 3 is transferred to the shuffler conveyor belt assembly 4*b*, which delivers the projectile 3 onto the elevation conveyor belt assembly 4*c*. If the projectile 3 passes through a target 18, the projectile 3 falls onto the upper energy damper 11.

From the upper or lower energy dampers (11 & 13), the projectile 3 moves onto the front conveyor belt assembly 4*a*. The front conveyer belt assembly 4*a* moves the projectile 3 to the shuffler conveyor belt assembly 4*b* and from there onto the elevation conveyor belt assembly 4*c*. The conveyor actuation sensor 14 detects and stops the projectile 3 at the end of the elevation conveyor belt assembly 4*c* in the ready position 25. From the ready position 25, the projectile 3 will be ready to be dropped into the launching position in the tray of the object feeder 17 when the linear actuator on the launcher assembly 2 signals the system controller 21 that object feeder 17 has returned to its retracted position. The system controller 21, in turn, restarts the projectile collection system 16, which delivers the projectile 3 that is waiting in the ready position 25 on the elevation conveyor belt assembly 4*c*. Next, the projectile collection system 16 runs until the conveyor actuation sensor 14 detects the next projectile 3 has reached the ready position at the top of the elevation conveyor belt assembly 4*c*.

Step 4: At a time of the player's choosing, the player will activate the actuator 1 to initiate steps one through three, thereby continuing the launch and retrieval cycle.

Example Component Functions and Descriptions

A listing of example system components is included in Table 1 below. Those of skill in the art will appreciate that not all of the components listed below are required for system functionality, and various embodiments can include additional components that modify, augment, or enhance system functionality. Further, skilled artisans will also appreciate that in some cases, one or more of the components listed below can be substituted for other components and devices that achieve similar functionality.

TABLE 1

Listing of Example System Components

| No. | Part Name |
|---|---|
| 1 | Actuator |
| 2 | Launcher assembly |
| 2a | Wheels |
| 2b | Motors |
| 3 | Projectile |
| 4a | Front Conveyor Belt Assembly |
| 4b | Shuffler Conveyor Belt Assembly |
| 4c | Elevation Conveyor Belt Assembly |
| 5 | Platform |
| 6 | Launcher & Target framework |
| 7 | Back Scoring Panel |
| 8 | Power & Control Housing |
| 9 | Launcher Cover |
| 10 | Launcher Back Cover |
| 11 | Upper Energy Damper |
| 12 | Scoreboard |
| 13 | Lower Energy Damper |
| 14 | Conveyor Actuation Sensor |
| 15 | Front Screen |
| 16 | Projectile Collection System |
| 17 | Object Feeder |
| 18 | Target |
| 19 | Power Supply |
| 20 | Emergency Stop Button |
| 21 | System Controller |
| 22 | Wrap-around Screen |
| 25 | Ready position |
| 26 | Conveyor Bars |
| 27 | Elevation Conveyor Belt Segment |
| 28 | Target Sensor |

TABLE 1-continued

Listing of Example System Components

| No. | Part Name |
|---|---|
| (not shown) | Camera |
| (not shown) | Projector |
| (not shown) | Images |
| (not shown) | Ready Sensor |
| (not shown) | Sensor Camera |
| (not shown) | Power Supply |
| (not shown) | Projector |
| (not shown) | Embedded Sensor Chip |
| (not shown) | Drones |

Actuator 1: The actuator 1 can be an electromechanical switch activated by a button, a touchscreen device, or contact-activated sensor that generates an object feed actuation signal to activate the object feeder 17. The object feed actuation signal can be transmitted over a hardwired connection or using wireless communication protocols. The object feed actuation signal can be transmitted directly to the system controller 21 to activate the object feeder 17, or the object feed actuation signal can be transmitted to a computing device, such as a platform computing device and/or a network server computing device, before being transmitted to the system controller 21. In other embodiments where, for example, the system controller 21 is replaced with a network computing device that provides central control, the object feed actuation signal is passed to the network computing device to activate the object feeder 17.

Launcher Assembly 2: The launcher assembly 2 is a device or subsystem that propels the projectile 3 to a user.

Wheels 2*a*: The Wheels 2*a* can be implemented as two rubber (or other elastomeric material) wheels that receive a projectile 3 from the object feeder 17 and that propel the projectile 3 to a user. The wheels 2*a* can be made from an elastomeric or other material capable of deforming to accommodate a projectile 3 but also sufficiently rigid to apply pressure to and grip a projectile 3 between the wheels 2*a*. The wheels 2*a* compress and grip the projectile 3. The spinning motion of the wheels 2*a* propels the projectile 3 toward the user.

The wheels 2*a* are spaced a distance apart to accommodate the particular projectile 3 size being utilized. That is, larger projectiles 3 will necessarily require a larger spacing. In some embodiments, the wheels 2*a* can be mounted to a mechanical assembly (e.g., a mechanical arm) and/or an automated wheel actuator that allows the wheels 2*a* to translate horizontally in a manner that increases or decreases the spacing between the wheels 2*a*. This feature allows the system to accommodate projectiles 3 of different sizes. The automated wheel actuator can be in signal communication with the system controller 21 or a centralized network computing device that adjusts the spacing in response to user inputs and/or automated computer-generated inputs determined by a software algorithm. For instance, if a user enters a setting on a platform computing device specifying that a current player is a youth, a software application running on a network computing device can determine proper wheel 2*a* spacing to accommodate a youth football before transmitting a signal to the controller 21 or an automated wheel actuator that adjusts the spacing between the wheels 2*a*. If the next user is an adult, the wheels 2*a* can be automatically adjusted during the adult users "turn" to accommodate a full size football.

An automated wheel actuator 2*a* can also be used to adjust the orientation, vertical height, or relative horizontal angle of the wheels 2*a* while motors 2*b* adjust the rotation speed of the wheels 2*a*. Adjustment to the wheel 2*a* positioning and rotation speed permits the system controller 21 or another computing device to dynamically aim a launched projectile 3. The projectile 3 can be aimed to accommodate varying game rules, users of different ages, or users who are spaced different distances away from the front screen 15 (e.g., advanced users who are farther away or novice users who are closer). The aim of a launched projectile 3 can be manually adjusted or automatically controlled through the system controller 21 or a computing device.

Motors 2*b*: Two variable speed, one-quarter or greater horsepower motors are mounted concentrically onto wheels and a steel frame. The motors 2*b* control the rotation speed of the wheels 2*a*. The motors are in signal communication with a system controller 21 or another computing device that permits manual or automated adjustment of the rotation speed. For instance, the rotation speed can be increased to account for heavier projectiles 3 or to propel a projectile a farther distance away, or the wheel speed can be reduced to accommodate lighter projectiles 3 or propel the projectile 3 over a shorter distance.

Projectile 3: An object to be thrown or hit toward a target.

Projectile collection system 16: One embodiment of the projectile collection system 16 includes multiple conveyor belt components that function together to collect projectiles 3 and return projectiles 3 to the launcher assembly 2. The projectile collection system 16 includes a front conveyor belt assembly 4*a*, a shuffler conveyor belt assembly 4*b*, an elevation conveyer belt assembly 4*c*, and one or more conveyor actuation sensors 14. The shuffler conveyor belt assembly 4*b* transfers projectiles 3 from the front conveyor belt assembly 4*a* to the elevation conveyor belt assembly 4*c*.

In other embodiments, the projectile collection system 16 can be implemented with other components configured to transfer projectiles to the launcher assembly. For example, the projectile collection system 16 can include a bin or repository that collects the projectiles 3 where the repository is connected to a conduit, such as a tube, that uses a vacuum force to transport the projectile 3 to the ready position 25 proximal to, or seated within, the object feeder 17. In other embodiments, the projectile collection system 16 can use pneumatic or hydraulic force, for example, to propel projectiles 3 through conduits that return projectiles 3 to a user position.

Front Conveyor Belt Assembly 4*a*: The front conveyor belt assembly 4*a* can be sized to span the full width of the platform 5 less the width of the shuffler conveyor belt assembly 4*b*. The front conveyor belt assembly 4*a* is configured with an approximately horizontal, flat orientation and sits at a lower height than the outlet opening through which the launcher assembly 2 propels projectiles 3 to minimize potential interference with the flight path of any launched projectiles 3.

Shuffler Conveyor Belt Assembly 4*b*: The shuffler conveyor belt assembly 4*b* receives a projectile 3 from front conveyor belt assembly 4*a* and transfers the projectile 3 from a front side of the front screen 15, around a bend, to a rear side of the front screen 15, and then to the elevation conveyor belt assembly 4*c*.

Lower Energy Damper 13: The lower energy damper 13 device is made from an energy absorbing material and located on a front side of the front screen 15 that faces the user position and platform 5. The lower energy damper 13 can be installed at the foot of the front screen 15 between the front screen and the platform 5. The lower energy damper 13 can have an arcuate or curved shape that directs 3 projectiles underneath the front screen 15 to the front conveyor assembly 4*a*.

The lower energy damper 13 is used to slow the fall of projectiles 3 that do not successfully pass through the targets 18 holes in the front screen 15. The lower energy damper 13 directs fallen projectiles 3 onto the front conveyor belt assembly 4*a*. Suitable energy or shock absorbing materials can include acrylic base resins, silicone base resins with low elasticity, silicone rubbers, silicone foams, polyurethanes, and various expanded foams. The energy absorbing material can be formed with a cellular structures, such as a honeycomb structure that distributes force across the cellular network when subject to sudden applied force.

Figure 6:
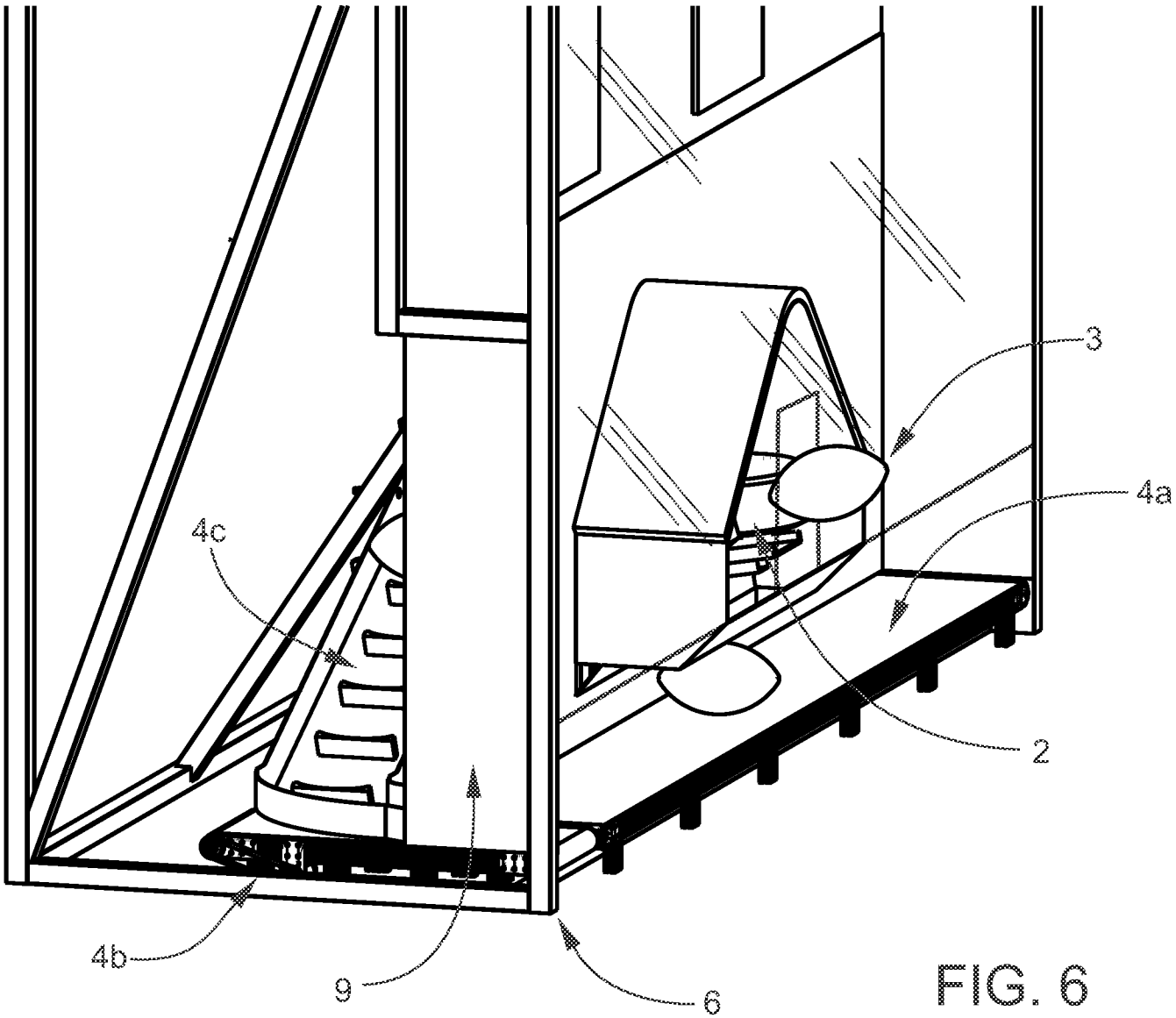
FIG. 6 is a rear view of a launcher system for an interactive projective game system according to one embodiment.

Upper Energy Damper 11: The upper energy damper 11 is made from an energy absorbing material and shaped to cover and protect the launcher assembly 2 and outlet opening and to direct the projectile 3 onto the front conveyor belt assembly 4*a*. The upper energy damper 11 can be configured in the shape of a downward sloping hood as shown in FIGS. 1 and 6.

Elevation conveyor belt assembly 4*c*: The elevation conveyor belt assembly 4*c* is configured to transport the projectile 3 to the ready position 25 using custom-shaped conveyor bars 26 and bar spacing that divide the elevation conveyor belt assembly 4*c* into elevation conveyor belt segments 27. Each elevation conveyor belt segment 27 accommodates a single projectile 3 to facilitate loading only one projectile 3 per segment 27. This device receives projectiles 3 from the shuffler conveyor belt assembly 4*b* and positions the projectiles 3 to be dropped one at a time, in a controlled sequence, into the object feeder 17 on the launcher assembly 2.

Platform 5: The platform 5 is a structure or surface on which the user stands when launching or receiving projectiles 3. The platform 5 can be formed from concrete, wood, or another suitable base material and covered with a suitable flooring material, such as, without limitation, artificial turf with an underlying padding layer, carpeting, hardwood, or tile.

Back scoring panel 7: The back scoring panel 7 can be used as a location to mount the target sensors 28 and absorb impact force from projectiles 3 that pass through the targets 18 and strike the back scoring panel 7. The target sensors 28 can be affixed to the back scoring panel 7 using an adhesive (e.g., a glue pad), a hook-and-loop fastening material, magnets, male-to-female snap fasteners (e.g., a button type fastener where a male or female portion is disposed on the back scoring panel or the target sensor 28), threaded fasteners, or other suitable attachment mechanisms.

The back scoring panel 7 can be made from an energy or shock absorbing material to mitigate ricochet of impinging projectiles 3, thereby facilitating the projectiles 3 falling in a more direct downward direction for collection by the front conveyor assembly 4*a*. In other embodiments, the back scoring panel 7 can be configured to operate as a target sensor 28 without the need for individual target sensors 28, as discussed above.

Targets 18: The targets 18 can be formed as openings in the front screen 15 and sized to permit projectiles 3 to pass through the openings and strike the back scoring panel 7. The targets 18 shown in the attached figures are circular, but other shapes can be used, such as rectangular target openings 18 to receive hockey puck or Frisbee® projectiles 3.

The targets 18 can be a uniform shape, size, and orientation over a single back scoring panel 7. Or a single back scoring panel 7 can have targets 18 of various sizes and orientations where, for example, each size or position corresponds to a different score awarded if a projectile 3 passes through the target 18. For example, a smaller target 18 size can result in a higher score awarded than a larger target 18; a target 18 closer to the center of the front screen 15 can result in a higher score than targets 18 near the edges of the front screen 15; or a target 18 that is in a higher vertical position on the front screen 15 can result in a higher score than a target 18 located at a lower vertical position. Those of skill in the art will appreciate that enumerable other scoring schema and target 18 configurations can be used to implement games, including games focusing on differing user skill sets.

In other embodiments, the targets 18 can be displayed on the front screen 15 using a projector or by configuring the front screen 15 as an electronic display device (e.g., a larger television or computer monitor, etc.). Projectile 3 strikes on the front screen 15 and targets 18 can be detected by photoelectric target sensors 28 or by contact target sensors 28 integrated with, or attached to, the front screen 15. In that case, the system might not require a separate back scoring panel 7, or a separate back panel can be used that provides structural support and/or a dampening and shock absorption function.

Power Supply 19: The power supply 19 is housed in the Power and Control Housing 8, and the power supply 19 distributes power from one or more supply inputs to the various system components. The power supply 19 can receive an input at a given voltage level and distribute power through one or more outputs at various voltage levels that are suitable for the components to which power is being supplied. As an example, the power supply 19 may receive an input at 240 volts alternating current ("VAC") that is stepped down to a 120 VAC output supply to various computer components (e.g., the system controller 21 or scoreboard 12) or stepped down further and/or converted for sensor components (e.g., 5 VDC for the target sensors 28).

System Controller 21: The system controller 21 can include one or more processors, transitory memory, and non-transitory storage that includes one or more integrated software programs that operate various system components. The system controller 21 can be programmable and configured to communicate with various system components and facilitate communication between and among components. That is, the system controller 21 can be configured to control the timing of the system components so as to operate the components proper sequence as well as configured to track and display scores and player information.

The system controller 21 operation is exemplified by the following example where a user selects the actuator 1, which sends a projectile 3 return signal to the system controller 21. The system controller 21 sends a launch actuation signal to the object feeder 17, which causes the object feeder 17 to thrust a projectile 3 between the wheels 2*a* for return to the user. When the object feeder 17 returns to the retracted position, the object feeder 17 sends a projectile feed signal to the system controller 21. The system controller 21 receives the projectile feed signal from the object feeder 17, and in response, transmits a conveyor start signal to the projectile collection system 16 components (4*a*, 4*b*, and 4*c*). The system controller 21 then receives a projectile detection signal from the conveyor actuation sensor 14 when a projectile 3 is detected, and in response, transmits a conveyor stop signal to the projectile collection system 16 components.

In one example embodiment, the system controller 21 incorporates components that include, without limitation: (i) a game control computer; (ii) a conveyor controller; (iii) three electronic speed controllers; (iv) three external electric motors that drive the conveyor belts of the projectile collection system 16; (v) external photoelectric sensors; (vi) a target score tracker controller; (vii) six external target projectile detectors; (viii) a launch controller; (ix) two electric speed controllers; (x) two external electric motors 2*b* that drive the wheels 2*a* of the launcher assembly 2; (xi) a user input controller that processes received user inputs; (x two external control pedals; and (xiii) an external score display monitor.

Object Feeder 17: The object feeder 17 is used to push the projectile 3 into the spinning wheels 2*a* on the launcher assembly. The object feeder 17 can be implemented with an integrated feed plunger operated by a linear actuated electromechanical motor, solenoid, hydraulic drive, or pneumatic drive, among other actuators.

Emergency Stop Button 20: The emergency stop button 20 can be installed as a button-actuated switch between the power input and the power supply 19 to cut system power if needed for maintenance or emergency.

Scoreboard 12: The scoreboard 12 is an electronic display device that outputs scores and other data and information to users. The scoreboard 12 can be connected to a computer device (e.g., a desktop computer) and one or more input devices (e.g., a mouse and keyboard). In other embodiments, the scoreboard is implemented with a touchscreen display that can also accept user inputs, such as user names, user ages, user skill levels, or game and scoring settings (e.g., selection of a particular game with predefined rules or scoring or game difficulty levels).

Conveyor actuation sensor 14: The system can include one or more conveyor actuation sensors 14 mounted proximal to the projectile collection system 16 components (4*a*, 4*b*, and 4*c*). The conveyor actuation sensors 14 detect projectiles 3 on the projectile collection system 16 components and, upon detection of a projectile 3, transmit a projectile detection signal to the system controller 21. The conveyor actuation sensors 14 can be implemented as: (i) optical sensors that detect changes in ambient light levels caused by passing projectiles 3; (ii) infrared sensors that transmit a beam of infrared light and detect breaks in the beam caused by passing projectiles 3; (iii) radar signals that emit radar waves and detect changes in reflected radar waves caused by passing projectiles 3; (iv) pressure sensors that detect pressure applied to the conveyor belts resulting from projectiles 3 in contact with the conveyor belt; or (v) other types of contact sensors detecting changes in resistance, voltage, current, or capacitance that result from contact between the conveyor belts and projectiles 3.

In one embodiment, a conveyor actuation sensor 14 is positioned at end of the elevation conveyor belt assembly 4*c* and used to stop the elevation conveyor belt assembly 4*c* when a projectile 3 reaches the end of the elevation conveyor belt assembly 4*c* in the ready position 25.

Front Screen 15: The front screen 15 can be made from an energy-absorbing material that, in one embodiment can be approximately ten to seventeen feet high and twelve to twenty-six feet wide that is connected to the launcher assembly 2 and the target framework 6, which is formed as a self-supportive, free-standing framework of tube steel or similar material. The front screen 15 will include holes of various sizes that serve as targets 18 for the player to pass the projectile 3 through.

Launcher cover 9: The launcher cover 9 is configured as a protective material between the front screen 15 and the back scoring panel 7. The launcher cover 9 encloses the space between the front screen 15 and the back scoring panel 7 and directs projectiles 3 that pass-through the targets 18 to the front conveyor belt assembly 4*a*. The launcher cover 9 thus keeps the projectiles 3 contained in the area above the front conveyor belt assembly 4*a* that is located between front screen 15 and the back scoring panel 7.

Launcher and target framework 6: The launcher and target framework 6 is a self-supportive, free-standing framework of tube steel or other rigid material that supports the front panel 15, launcher cover 9, back scoring panel 7, and other system components.

Power and control housing 8: The power and control housing 8 is formed as a metal enclosure for housing and mounting the power supply 19 and the system controller 21.

Launcher back cover 10: The launcher back cover 10 is installed behind the launcher assembly 2 to protect the launcher assembly 2 components.

Alternate Embodiments

Those of skill in the art will recognize that the accompanying figures are not intended to be limiting, and multiple embodiments of the interactive game system can be implemented using the devices and techniques described in this disclosure. To illustrate, alternative embodiments denoted as "Phase 1" and "Phase 1A" can be integrated into either a mobile interactive game system or a free standing system installed in a more permanent brick and mortar setting. These embodiments include the projectile collection system 16, the launcher assembly 2, the actuator 1, and a target screen for users to throw toward. Phase 1 includes a front screen 15 and a back scoring panel 7. The front screen 15 has target 18 openings. The target 18 openings receive projectiles 3 propelled by a user. The back scoring panel 7 is installed located behind the front screen 15 and stops projectiles 3 that pass through the targets 18. The back scoring panel 7 can be made of a shock absorbing or energy dampening material that absorbs the force of a projectile 3 to mitigate the projectile 3 ricochet and direct the projectile 3 downward to the projectile collection system 16 below.

The Phase 1A embodiment includes one screen with moving drones (not shown in the figures) that are housed in cages and that serve as targets. If a projectile 3 successfully strikes a target drone, points will appear on a scoreboard located at the top of the front screen.

A Phase 2 embodiment replaces the dual-screen configuration (i.e., the front screen and back panel screen) with a single screen. The single screen is optionally implemented as a one hundred and seventy degree, wrap-around screen 22 that surrounds players to give players a feeling of immersion in a realistic sporting scenario. An example wrap-around screen is shown in FIGS. 9A-9D. Images of targets are projected onto the screen 22. The projected targets could resemble, for example, stationary or mobile football players.

The Phase 2 embodiment can include a plurality of sensors that form part of a tracking system to measure projectile 3 accuracy, speed, position, and other performance metrics. Sensors can include, for example, optical sensors or radar detectors that detect projectile 3 speed and position. Contact, tactile, pressure, or force sensors can be used to measure projectile 3 strike location and force. The Phase 2 embodiment is implemented as part of a brick-and-mortar establishment serving as a permanent sports entertainment venue.

A Phase 3 embodiment is implemented as an indoor or outdoor version that includes a plurality of platforms 5 co-located in the same venue. The plurality of platforms 5 can be identical or can be configured to accommodate players of different skill levels, such as having various distances between the actuator 1 and the targets or the launcher assembly 2. The projectile collection system for the Phase 3 embodiment can be implemented as a larger, integrated system capable of transporting projectiles between and among platforms 5 or to a central repository location.

In one embodiment of Phase 3, the system does not include a separate screen. Instead, users propel projectiles into a field having a flat or sloped surface that contains several targets. Some targets will be stationary targets installed in the ground while other targets will be airborne, such as mobile drones protected by a cage. The sloped surface allows the projectile to roll into a much larger projectile collection system than the Phase 1 and Phase 2 embodiments for return to a corresponding launcher assembly 2.

Alternate Embodiment Components

Projector: The projector directs images onto a screen that can include both stationary and moving targets. In one example embodiment that simulates a U.S. football game, the image projected onto the screen will consist of a view similar to an offensive quarterback's view as the play unfolds in front of the quarterback. Other embodiments can project images onto the screen that simulate other sports or interactive game scenarios, such as projecting images of hockey players and goals and prompting a user to propel a puck toward the projected players and goals or projecting images that resemble extraterrestrial objects that serve as targets 18 in a surrounding background that resembling outer space.

Projectile: As in other embodiments, the projectile can be a ball, birdie, puck, Frisbee® or another object capable of being thrown, kicked, or struck so as to launch the projectile through the air in a targeted flight path. The projectile can include an embedded microchip detected through RFID or a sensor camera.

Tracking System: The interactive game system can include a tracking system implemented with a sensor camera that tracks the speed and flight path of the projectile as it relates to the images on the screen to determine the accuracy of the user's attempt to strike targets coupled to, or projected onto, the screen. The tracking system can also be implemented using Light Detection and Ranging or 3D camera technology that determines projectile ranges (variable distance) by targeting the projectile with a laser and measuring the time for the reflected light to return to a receiver.

Software: The projector can be in signal communication with a computing device that includes one or more integrated software applications configured to operate the projector. The projector creates imagery to facilitate game play, training, and/or to enhance the user experience, such as projecting an image of a stadium filled with fans onto the screen to provide an immersive, life-like feel of a live sporting event. The imagery can include virtual fans who react to the user's performance similar to a real game situation. The software further projects images of players on a field from the user's perspective. The images of the players will include both moving and stationary targets. The user propels the projectile toward targets projected onto, or affixed to, the screen. The system tracks the embedded microchip in the projectile to register data concerning the flight path of the projectile, whether the projectile strikes a target, projectile speed, impact force, or other performance metrics. The system can also include integrated software applications installed on a central network computing device or system controller that controls various aspects of system operation, such as launcher assembly operation, projectile collection system operation, and associated lighting.

Although the foregoing description provides embodiments of the invention by way of example, it is envisioned that other embodiments may perform similar functions and/or achieve similar results. Any and all such equivalent embodiments and examples are within the scope of the present invention.

What is claimed is:

1. An interactive projectile game system comprising:

(a) an actuator, (b) a launcher assembly;

(c) a projectile;

(d) a target comprising an opening in a front screen that is spaced a distance from a user position;

(e) a lower energy damper, wherein the lower energy damper is installed proximal to the foot of the front screen on a side of the front screen facing the user position, and (f) a projectile collection system proximal to the at least one target, wherein (i) selecting the actuator activates the launcher assembly to propel the projectile toward a user position, (ii) the user propels the projectile toward the target, (iii) the projectile collection system receives the projectile, (iv) the projectile collection system transfers the projectile to the launcher assembly, (v) the projectile collection system comprises front conveyor assembly that runs at least partially along a length of a foot of the front screen and that is installed on a side of the front screen opposite the user position, and wherein, (vi) the lower energy damper has a shape that slopes downward underneath the front screen toward the front conveyor assembly, and the lower energy damper directs projectiles to the front conveyer assembly.

2. The interactive projectile game system of claim 1, wherein the target comprises an image projected on a front screen that is spaced a distance from the user position.

3. The interactive projectile game system of claim 1, wherein:

(a) the system further comprises (i) a back scoring panel adjacent to a rear side of the front screen opposite the user position, (ii) a target sensor, (iii) a system controller, and (iv) a scoreboard display device;

(b) when the projectile passes through the target opening, the target sensor generates a scoring signal that is transmitted to the system controller; and (c) the system controller converts the scoring signal into a point value that is displayed on the scoreboard display device.

4. The interactive projectile game system of claim 3, wherein the target sensor is an infrared sensor.

5. The interactive projectile game system of claim 3 further comprising a plurality of targets, wherein each target corresponds to a predetermined point value.

6. The interactive projectile game system of claim 1, wherein:

(a) the launcher assembly comprises an object feeder, (ii) a first wheel and a second wheel, (iii) a space between the first wheel and the second wheel, wherein the space is sized to accommodate the projectile, and (iv) a motor coupled to the first wheel and the second wheel, wherein the motor is configured to rotate the wheels; and wherein (b) the projectile is loaded in the object feeder;

(c) selecting the actuator activates the object feeder to place the projectile in the space between the first wheel and the second wheel; and (d) when the projectile is placed in the space between the first wheel and the second wheel, the first wheel and the second wheel frictionally engage the projectile and propel the projectile toward the user position.

7. An interactive projectile game system comprising:

(a) an actuator;

(b) a launcher assembly;

(c) a projectile;

(d) a target comprising a target opening in a front screen that is spaced a distance from a user position;

(e) a target sensor;

(f) a system controller; and (g) a scoreboard display device, wherein (i) when the projectile passes through the target opening, the target sensor generates a scoring signal that is transmitted to the system controller, and (ii) the system controller converts the scoring signal into a point value that is displayed on the scoreboard display device;

(h) a back scoring panel adjacent to a year side of the front screen opposite the user position, wherein the target sensor is secured to the back scoring panel in a position aligned with the target opening; and (i) a projectile collection system proximal to the at least one target, wherein (i) selecting the actuator activates the launcher assembly to propel the projectile toward a user position, (ii) the user propels the projectile toward the target, (iii) the projectile collection system receives the projectile, and (iv) the projectile collection system transfers the projectile to the launcher assembly.

8. An interactive projectile game system comprising:

(e) an actuator;

(f) a launcher assembly;

(g) a projectile;

(h) a target comprising a target opening in a front screen that is spaced a distance from a user position;

(i) a target sensor;

(j) a system controller; and (k) a scoreboard display device, wherein (i) when the projectile passes through the target opening, the target sensor generates a scoring signal that is transmitted to the system controller, and (ii) the system controller converts the scoring signal into a point value that is displayed on the scoreboard display device;

(l) a back scoring panel adjacent to a rear side of the front screen opposite the user position; and (m) a projectile col lection system proximal to the at least one target, wherein (i) selecting the actuator activates the launcher assembly to propel the projectile toward a user position, (ii) the user propels the projectile toward the target, (iii) the projectile collection system receives the projectile, (iv) the projectile collection system transfers the projectile to the launcher assembly, (v) the projectile collection system comprises (A) a front conveyor belt assembly coupled to a shuffler conveyor belt assembly, and (B) an elevation conveyor belt assembly coupled to the shuffler conveyor belt assembly, (vi) the front conveyor belt assembly (A) receives the projectile launched toward the target, and (B) transfers the projectile to the shuffler conveyor belt assembly, (vii) the shuffler conveyor belt assembly transfers the projectile to the elevation conveyor belt assembly, and (viii) the elevation conveyor belt assembly transfers the projectile to the launcher assembly.

9. The interactive projectile game system of claim 8 further comprising a conveyor actuation sensor coupled to the elevation conveyor belt assembly, wherein:

(a) the conveyor actuation sensor is configured to detect the projectile while the elevation conveyor belt assembly is in motion;

(b) when the conveyor actuation sensor detects the projectile, the conveyor actuation sensor transmits a projection detection signal to the controller;

(c) when the controller receives the projection detection signal, the controller transmits a conveyor stop signal to the projection collection system; and (d) when the projection collection system receives the conveyor stop signal, the projection collection system stops the elevation conveyor belt assembly motion.

10. The interactive projectile game system of claim 9, wherein:

(a) the elevation conveyor belt assembly comprises conveyor bars that divide the elevation conveyor belt assembly into belt segments; and wherein (b) the belt segments as sized to accommodate the projectile.

11. An interactive projectile game system comprising:

(a) an actuator;

(b) a launcher assembly that comprises an object feeder;

(c) a projectile loaded within the object feeder;

(d) at least one target comprising an opening in a front screen that is spaced a distance from a user position (e) a lower energy damper, wherein the lower energy damper is installed proximal to the foot of the front screen on a side of the front screen facing the user position, and;

(f) a projectile collection system proximal to the at least one target; and (g) a controller in signal communication with each of the actuator, the launcher, and the projectile collection system, wherein (i) when a user selects the actuator, the actuator transmits a projectile return signal to the controller, (ii) when the controller receives the projectile return signal, the controller transmits a launch activation signal to the launcher assembly, (iii) when the launcher assembly receives the launch activation signal, the launcher assembly propels the projectile to a user position, (iv) the user accepts the projectile and propels the projectile toward the target, (v) the projectile collection system receives the projectile, (vi) the projectile collection system transfers the projectile to the object feeder, (vii) the projectile collection system comprises front conveyor assembly that runs at least partially along a length of a foot of the front screen and that is installed on a side of the front screen opposite the user position, and wherein (viii) the lower energy damper has a shape that slopes downward underneath the front screen toward the front conveyor assembly, and the lower energy damper directs projectiles to the front conveyor assembly.

12. The interactive projectile game system of claim 11, wherein the target comprises an opening in a front screen that is spaced a distance from the user position.

13. The interactive projectile game system of claim 11, wherein the target comprises an image projected on a front screen that is spaced a distance from the user position.

14. The interactive projectile game system of claim 11, wherein:

(a) the system further comprises (i) a target sensor proximal to the target, (ii) a system controller, and (iii) a scoreboard display device;

(b) when a projectile strikes the target sensor, the target sensor generates a scoring signal that is transmitted to the system controller; and (c) the system controller converts the scoring signal into a point value that is displayed on the scoreboard display device.

15. The interactive projectile game system of claim 14 further comprising a plurality of targets, wherein each target corresponds to a predetermined point value.

* * * * *